US009159517B2

(12) United States Patent
Chang

(10) Patent No.: US 9,159,517 B2
(45) Date of Patent: Oct. 13, 2015

(54) PHOTOCATHODE ENHANCEMENT SYSTEM

(71) Applicant: FAR-TECH, Inc., San Diego, CA (US)

(72) Inventor: Xiangyun Chang, Miller Place, NY (US)

(73) Assignee: FAR-TECH, INC., San Diego, CA (US)

( * ) Notice: Subject to any disclaimer, the term of this patent is extended or adjusted under 35 U.S.C. 154(b) by 321 days.

(21) Appl. No.: 13/691,708

(22) Filed: Nov. 30, 2012

(65) Prior Publication Data

US 2014/0152175 A1 Jun. 5, 2014

(51) Int. Cl.

| | |
|---|---|
| ***H01J 29/98*** | (2006.01) |
| ***H01J 1/34*** | (2006.01) |
| ***H01J 1/88*** | (2006.01) |

(52) U.S. Cl.

CPC .... *H01J 1/34* (2013.01); *H01J 1/88* (2013.01)

(58) Field of Classification Search

None

See application file for complete search history.

(56) References Cited

U.S. PATENT DOCUMENTS

| | | | | |
|---|---|---|---|---|
| 2,644,031 | A * | 6/1953 | Klyce | 348/196 |
| 3,900,760 | A * | 8/1975 | Glenn et al. | 315/17 |
| 4,671,778 | A * | 6/1987 | Musselman | 445/73 |
| 2006/0033417 | A1 * | 2/2006 | Srinivasan-Rao et al. | 313/399 |

* cited by examiner

*Primary Examiner* — Lincoln Donovan
*Assistant Examiner* — Khareem E Almo
(74) *Attorney, Agent, or Firm* — Elizabeth Kim Patent Law Offices LLC

(57) ABSTRACT

A photocathode enhancement system includes a cathode plate that is movably positioned relative to an incident optical beam. The emission surface of the cathode plate has an area between about 0.5 $cm^2$ to greater than 100 $cm^2$. The system includes a motion controller that is configured to control the movement of the cathode plate relative to the optical beam, so that the optical beam successively strikes non-overlapping portions of the emission surface, and may reach substantially the entire emission surface over a time period of about 10 seconds to about 100 seconds. The movement of the cathode plate is controlled so that on average, the heat from the optical beam is uniformly distributed over the emission surface of the cathode plate.

25 Claims, 3 Drawing Sheets

PHOTOCATHODE ENHANCEMENT SYSTEM

BACKGROUND

In a number of modern accelerator based applications, there is growing need for photocathode electron sources that can achieve high brightness and high-average-current, while at the same time lasting for long lifetimes. Examples of such applications include, without limitation, high-average-power free electron lasers (FELs), electron ion colliders (EICs), coherent electron coolers (CECs) and other energy recovery linac (ERL) based applications.

Typically, photocathodes can be used in devices such as RF guns and DC voltage guns. To achieve a high-brightness beam, the laser spot size (i.e. cathode emission spot) should be small, so that the thermal emittance is low. To achieve high-average-current, a high bunch charge and high repetition rate is needed. A high bunch charge beam generated with a small laser spot size requires a high field gradient on the cathode, in order to reduce space charge effects near the cathode. A high field gradient, however, can cause electrical breakdown issues. Another significant problem with semiconductor photocathodes is their short lifetime, due to their high sensitivity to the vacuum. These cathodes cannot operate with very high average current.

A number of approaches have been developed to overcome the insufficient charge lifetime ($Q_T$) problem of photocathodes. These approaches suffer, however, from a number of problems, including without limitation: increases in emittance; cathode center damage due to ion back-bombardment; and laser heating from very high power lasers, which may overheat or even crack the cathode.

BRIEF DESCRIPTION OF THE DRAWINGS

The drawings disclose illustrative embodiments. They do not set forth all embodiments. Other embodiments may be used in addition or instead. When the same numeral appears in different drawings, it is intended to refer to the same or like components or steps.

DESCRIPTION

In the present disclosure, methods and systems are disclosed relating to photocathode enhancement systems. Illustrative embodiments are discussed. Other embodiments may be used in addition or instead.

Figure 1:
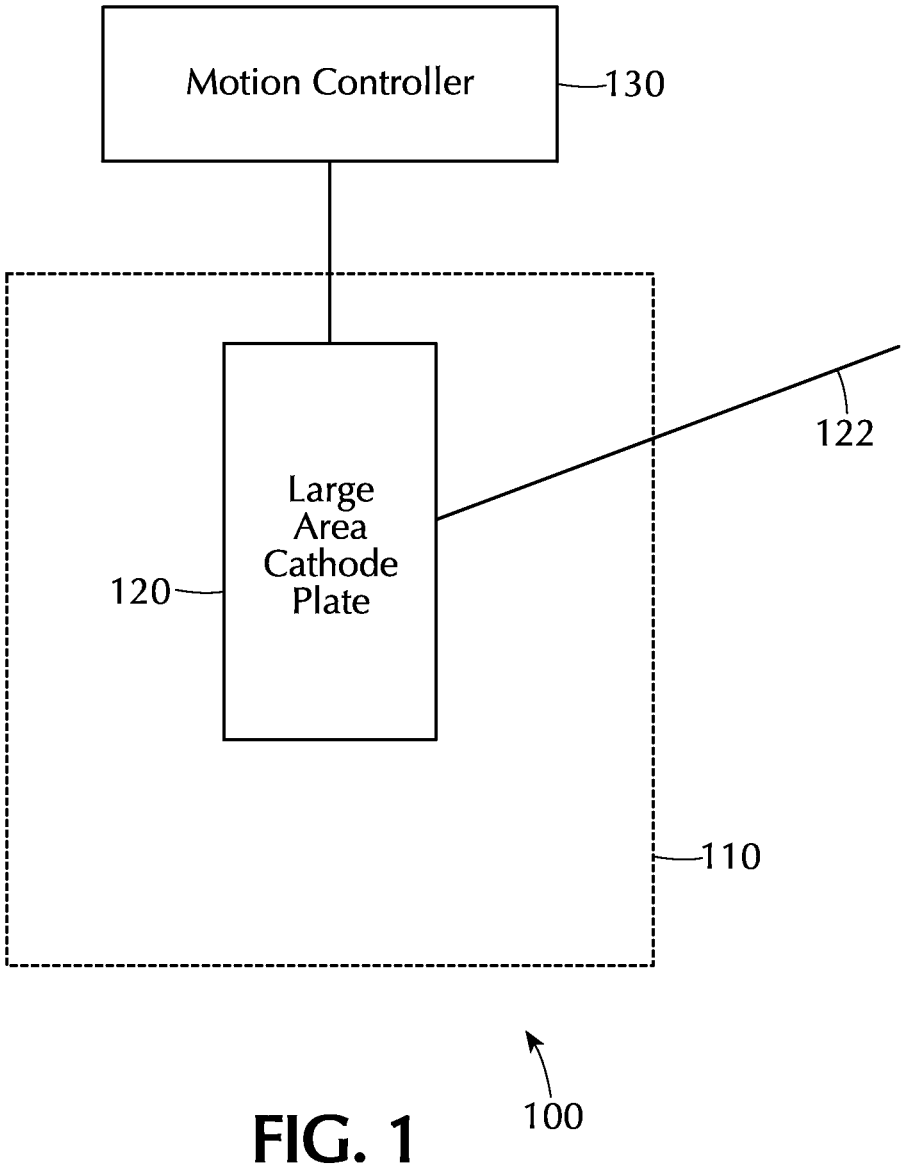
FIG. 1 is a schematic block diagram of a photocathode enhancement system, in accordance with one or more embodiments of the present application.

FIG. 1 is a schematic block diagram of a photocathode enhancement system 100 in accordance with one or more embodiments of the present application. As described in further detail below, the photocathode enhancement system 100 can increase the charge lifetime $Q_T$ of photocathodes by up to a couple orders of magnitude.

In order to attain a high $Q_T$, high-brightness photocathode system that can operate at a high average-current, in general the photocathode system 100 should have, or equivalently have: a large cathode surface so that $Q_T$ can be increased; a small laser spot size, and a high field gradient on the cathode to reduce emittance. Further, the photocathode system 100 should be maintained under ultra-high-vacuum (UHV), where the UHV should be better than about $10^{-11}$ torr for a polarized beam.

In general, the lifetime of a photocathode can be characterized by its charge lifetime $Q_T$, which is defined as the amount of charge that can be extracted before the QE (quantum efficiency) falls to 1/e of its initial value:

$$Q_T = I \times \tau(I)$$

where I is the emission current and $\tau$ is the lifetime at current I.

In overview, the photocathode enhancement system 100 includes a photocathode 110 having a cathode plate 120 whose emission surface is greater by one or two orders of magnitude, compared to the emission surface of conventional photocathodes, and which is movably positioned relative to an incident optical beam 122. In one or more embodiments, the emission surface may be about 100 $cm^2$. It should be understood that a wide variety of possible areas of the emission surface is covered by the present application, including surface areas up to a few hundred $cm^2$ or more, and surface areas between about 0.5 $cm^2$ and about 100 $cm^2$.

The system 100 further includes a motion controller 130 configured to control the movement of the cathode plate 120 relative to the optical beam 122. In many applications, the optical beam 122 is a laser beam, although in different embodiments, other types of optical beams may also be used.

The motion controller 130 is configured to control the movement of the cathode plate 120 in such a way that the laser beam successively strikes non-overlapping portions of the emission surface of the cathode plate 120. In this way, the laser beam reaches substantially the entire emission surface, over a time period that typically runs for tens of seconds. In some embodiments of the present application, the time period may be between about 10 seconds to about 100 seconds. In other embodiments, the time period may be shorter, for example between about 1 to 10 seconds.

By controlling the movement of the cathode plate 120 in this way, the charge lifetime $Q_T$ of the photocathode may be increased to 100 $Q_{TF}$ or more, where $Q_{TF}$ stands for the charge lifetime of a conventional fixed position photocathode, when the emission surface of the cathode plate 120 is greater than about 100 $cm^2$. Typically, the value of $Q_{TF}$ depends on system conditions, and is around 1000 C for a non-polarized beam and 200 C for a polarized beam.

In some embodiments of the present application, the motion controller 130 is configured to control the movement of the cathode plate 120 so that on average, the heat from the optical beam is uniformly distributed over the emission surface of the cathode plate 120. Typically, the movement of the cathode plate 120 may be controlled to a speed of about 1 cm/sec to about 10 cm/sec, although other speed ranges are also within the scope of the present application.

As described in more detail in conjunction with FIG. 2 below, in some embodiments the motion controller 130 controls the movement of the cathode plate 120 so that it undergoes a substantially smooth and continuous motion. In general, the cathode plate 120 may undergo a curvilinear motion, or a rectilinear motion, or some combination thereof.

Figure 2:
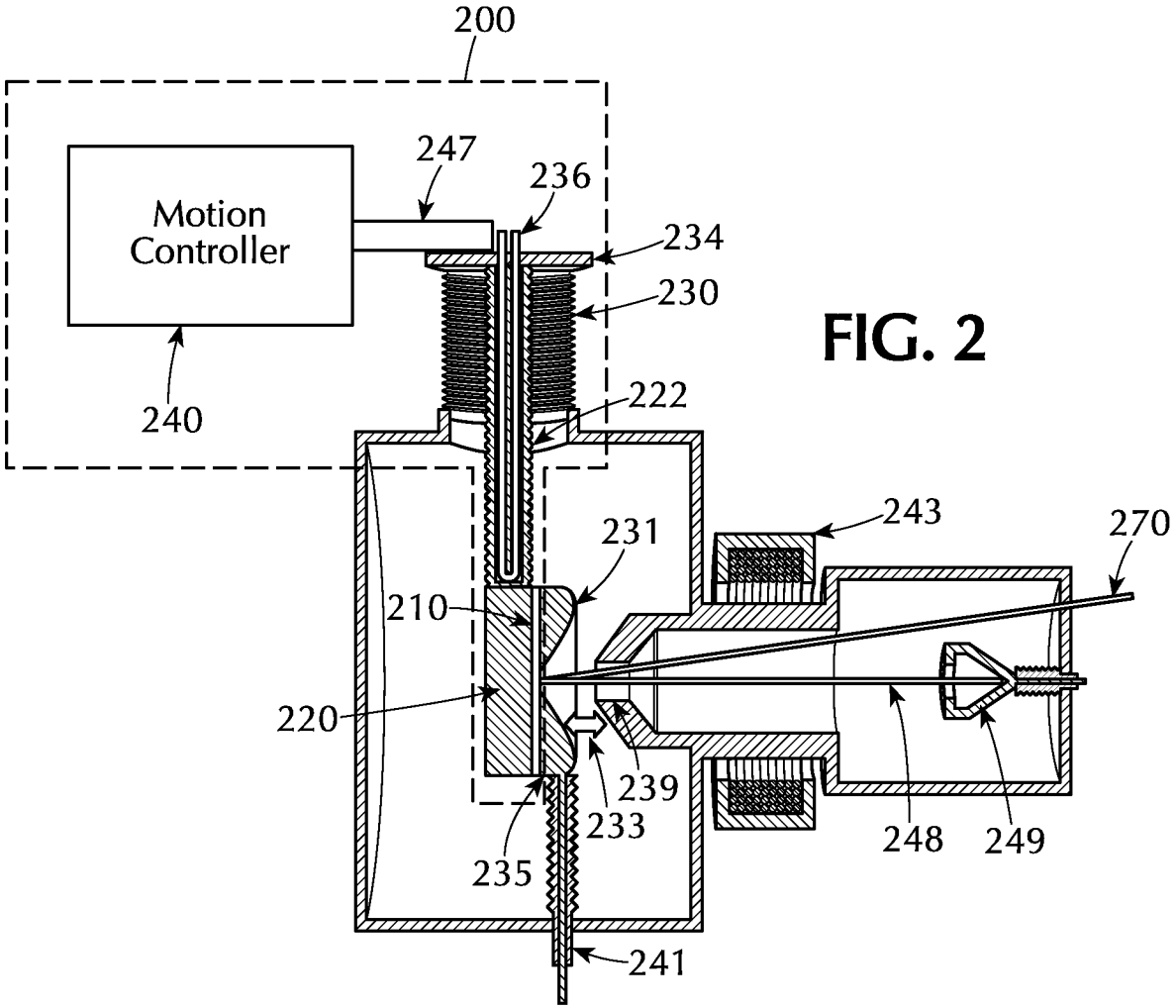
FIG. 2 is a detailed diagram of one embodiment of a photocathode enhancement system.

FIG. 2 illustrates one particular exemplary embodiment of the present application. In the illustrated embodiment, the insulating pillar is mounted on a flange of a UHV bellow, which in turn is mounted on the motion controller 130 that controls the movement of the cathode plate 120.

The photocathode enhancement system 200 is shown outlined by a dashed line in FIG. 2, and mounted on an existing photocathode system. In overview, the photocathode enhancement system 200 shown in FIG. 2 includes: a large surface-area cathode plate 210; a cathode holder 220; a supporting insulator pillar 222; a vacuum system comprising an ultra-high-vacuum (UHV) bellow 230 with a flange 234; a cooling tube 236; and a motion manipulation system (or motion controller) 240 disposed outside of a vacuum system.

In the present application, the terms "motion manipulation system" and "motion controller" have the same meaning, and are used interchangeably.

In the system 200, a conventional cathode is replaced by a large piece cathode, namely a cathode plate 210 having a much larger surface area compared to the conventional cathodes. In one or more embodiments, the surface area of the cathode plate 210 may be about 100 $cm^2$.

In some embodiments, including the illustrated embodiment, the cathode plate 210 is a single piece cathode plate with the larger surface area. In other embodiments, the cathode plate 210 may include a plurality of discrete component plates, each component plate having an emission surface area that adds up to a total surface area that is much larger compared to the surface area of conventional small cathodes.

In some embodiments, an optional cathode electrode 231 may be provided. The cathode electrode 231, as well as all components shown to its right, are part of and same as conventional photocathodes. In the illustrated embodiment, the cathode electrode 231 is supported by a fixed position high voltage (HV) feedthrough 241. A solenoid 243 or other optics are typically used to guide the electron beam 248, as in conventional photocathode systems. In the illustrated embodiment, a beam dump such as a depressed-collector 249 can collect the wasted beam.

In the illustrated embodiment, a small cathode gap 235 is provided between the cathode plate 210 and the cathode electrode 231. An accelerating gap 233 is defined between the cathode electrode 231 and an anode 239. The small gap 235 allows for free movement of the cathode plate 210 relative to the cathode electrode 231, while keeping an electrical connection (not shown) between them. In the illustrated embodiment, the gap 235 allows the cathode plate 210 to move transversely relative to the cathode electrode 231, although different configurations are possible in other embodiments of the present application.

In some embodiments, the motion manipulation system 240 may include a motion confinement system that is configured to keep size of the cathode gap 235, and thus the size of the accelerating gap 233 substantially constant, during the operation of the photocathode.

In the illustrated embodiment, the cathode plate 210 is mounted on the cathode holder 220, and the cathode holder 220 is supported by the supporting insulator pillar 222 inside the vacuum. The insulator pillar 222 is mounted on the flange 234 of the UHV bellow 230.

The bellow flange 234 is mounted on a mechanically stiff motion manipulation system 240, which is disposed outside of the vacuum as noted above. The motion manipulation system 240 is connected to the UHV bellow flange 234 through a moving arm 247. The motion manipulation system 240 controls the movement of the bellow flange 234, and consequently also the movement of the cathode plate 210.

In the illustrated embodiment, a cooling tube 236 is provided. The cooling tube 236 is configured to carry the heat (caused by the laser beam 270) out of the cathode plate 210.

The motion manipulation system 240 controls the movement of the cathode plate 210 in such a way that, during operation, the cathode plate 210 moves continuously and the laser constantly strikes a fresh or partially fresh spot on the cathode plate. In this way the entire emission surface is periodically and evenly used, on average, during operation.

In some embodiments, the motion manipulation system 240 controls the speed of the motion of the cathode plate to a few cm/sec, typically between about 1 cm/sec to about 10 cm/sec. The motion does not need to be very fast during the operation of the photocathode, as long as the motion can evenly expand the heat from laser over a large cathode area, in such a way that the peak temperature increase is sufficiently low at any point on the cathode.

The sweep time on any point on cathode during one sweep cycle, assuming a laser spot size of a few millimeters in diameter, is a few hundred milliseconds or less. In general this time period is much shorter than its lifetime, therefore the QE variation during each sweep cycle is negligible, and emission current will vary smoothly.

Another motion related emission problem is the uneven QE distribution of the cathode plate. The uneven QE distribution may cause current stability problem. In some embodiments of the present application, a laser feedback system is provided that may solve this problem, as the cathode motion is not very fast.

In the illustrated embodiment, the supporting insulator 222 is mounted vertically to stabilize the motion. The moving arm of the motion manipulation system 240 is confined on a stiff, vertical and flat plate. In this way, the moving parts will move smoothly in the transverse direction, while the size of an acceleration gap 233 is kept constant.

Accuracy of the motion manipulation system is important, especially in the beam longitudinal direction. A beam longitudinal motion error causes accelerator gap ($L_{Acc}$) error. The defocusing angle (A) of a beam at anode exit can be approximated as: $\theta \approx r/2L_{Acc}$, where r is the beam size near anode exit. Assume 2 cm of $L_{Acc}$, 2 mm of r and 0.2 mm of $L_{Acc}$ error, the equivalent spread of θ between pulses will be: $\Delta\theta \approx (r/2L_{Acc}) \times (\Delta L_{Acc}/L_{Acc}) \approx 0.5\ m_{rad}$. This is equivalent to a geometric emittance of 1 μm. In fact, as the cathode electrode is fixed, Δθ due to $L_{Acc}$ error will be smaller than the above estimation. A less than 1 μm emittance increase is a tolerable margin of error in most of the high bunch charge applications.

Since the entire surface area of the cathode plate 210 eventually participates in the emission, the entire cathode plate area becomes an effective cathode area. Thus, the cathode plate area can be made a few hundred times larger, i.e. a couple orders of magnitude larger, compared to the cathode plate area of conventional cathodes. As a consequence, the $Q_T$ of the photocathode is increased by a few hundred times, provided there is no degradation of the vacuum. For these reasons, the above-described photocathode enhancement system 200 is equivalent to replacing hundreds of cathodes with new ones without any disruption in the operation of the gun to actually perform the replacement.

In addition to increasing $Q_T$ by a factor of a few hundred or so, the above-described cathode enhancement system allows for the laser power to be evenly expanded, on average, over a large cathode area. In this way, the local peak temperature on the cathode is much smaller than when the laser is focused on a tiny stationary spot. While cathode damage due to ion-bombardment is not eliminated, like laser power, such damage will be distributed over the whole cathode plate, thus its impact reduced.

With the above-described photocathode enhancement system 200, the electron gun can operate with a small accelerating gap 233, so that the field gradient on cathode is sufficiently high even with a relatively small cathode-anode voltage. The high cathode field gradient allows a small laser spot, which reduces the thermal emittance.

Electron bunches originating from different positions of the cathode plate have identical trajectories and optics on the beamline, thus it is easy to optimize the optics to minimize beam loss.

In some embodiments, including the illustrated embodiment, both polarized and non-polarized electron beams are applicable.

A major requirement of the above-described photocathode enhancement system 200 is to maintain UHV during operation. For enhancement systems using polarized beams, in particular, it is desirable that the vacuum be better than $10^{-11}$ torr or so. For higher maximum current density and lower emittance, higher HV is preferred, although that will make it difficult to achieve UHV. The better the vacuum that can be achieved, the better the system performance. It is very costly, however, to build a vacuum system much beyond $10^{-11}$ torr. A suitable vacuum specification should thus be procured when designing the above-described enhancement system.

For the HV electrical feedthroughs, 100 kV HV electrical feedthroughs that are commercially available may be used. In some embodiments, the HV insulators may be customized, for higher HV and special cooling requirement.

In some embodiments, the UHV bellow 230 is one of the largest outgassing sources due to its large total surface area and low flow conductance between the welded diaphragms. By choosing a suitable size for the UHV bellow 230, vacuum degradation can be minimized.

In some embodiments, the UHV bellow 230 may have an infinite cycle lifetime. Commerically available UHV bellows with this property may be used in these embodiments.

The above-described photocathode enhancement system 200 may include one or more processing systems configured to carry out all of the methods set forth above. In particular, the processing systems may be configured to optimize parameters such as the range and speed of motion of the cathode plate and other components of the enhancement system 200, the distribution of heat from the optical beam over the emission surface of the cathode plate, and the vacuum conditions within the enhancement system 200. The processing systems may be further configured to controllably operate the photocathode enhancement system 200 using such optimized parameters.

Any type of computer or processing system may be used to implement the methods, systems, kinetics, and algorithms described in the present application, including but not limited to general purpose processors, PCs, and workstations.

The methods and systems in the present application are not described with reference to any particular programming language. It will be appreciated that a variety of platforms and programming languages may be used to implement the teachings set forth above.

The processing systems may be selectively configured and/or activated by a computer program stored therein. Such a computer program may be stored in any computer usable storage medium, including without limitation any type of disk including floppy disks, optical disks, CD-ROMs, and magnetic-optical disks, ROMs (read-only memories), RAMs (random access memories), EPROMs (erasable programmable read-only memories), EEPROMs (electrically erasable programmable read-only memories), magnetic or optical cards, or any type of media suitable for storing electronic instructions.

Figure 3:
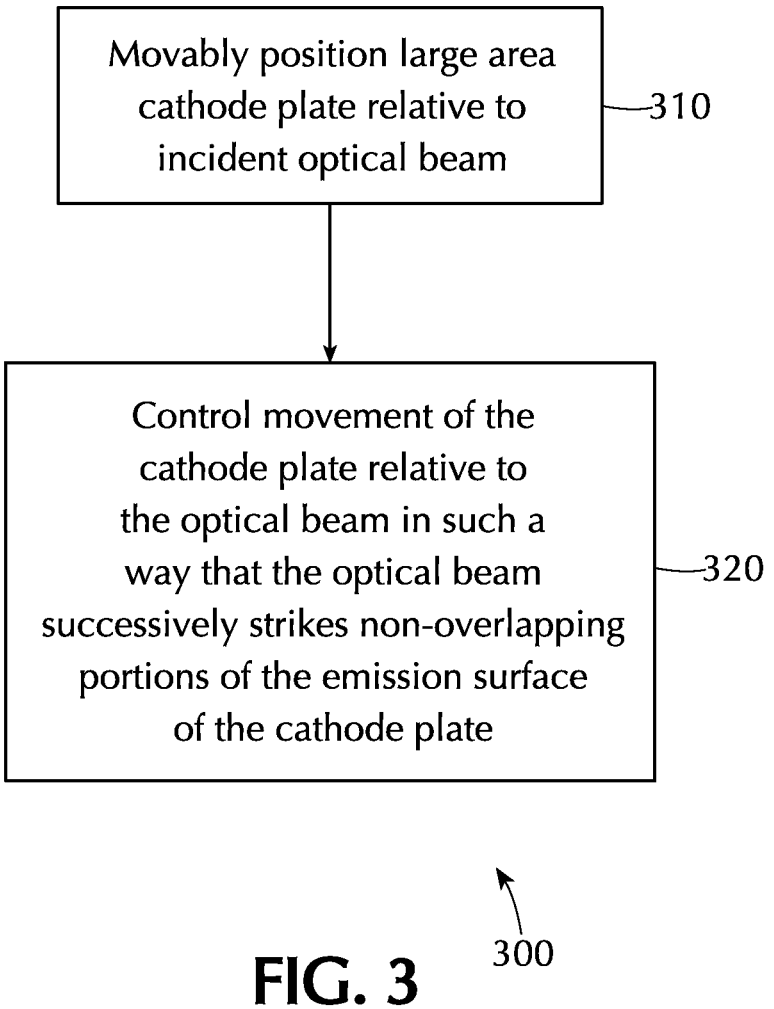
FIG. 3 is a schematic flow chart of a method of increasing charge lifetime of a photocathode, in accordance with some embodiments of the present disclosure.

FIG. 3 is a schematic flow chart of a method 300 of increasing charge lifetime $Q_T$ of a photocathode, in accordance with some embodiments of the present disclosure. The method 300 includes an act 310 of movably positioning a cathode plate of a photocathode relative to an incident optical beam, where the cathode plate has an emission surface of at least 0.5 $cm^2$. The method 300 further comprises an act 320 of controlling movement of the cathode plate relative to the optical beam in such a way that the optical beam successively strikes non-overlapping portions of the emission surface, so as to reach substantially the entire emission surface over a time period between about 10 to about 100 seconds.

In sum, methods and systems have been described relating to photocathode enhancement. The implementation of these systems will facilitate production of cathodes required e.g. by ERL based accelerator applications, including without limitation: electron cooling for ion beams, EICs, CECs, and high-average-power FELs. The improvement in emission ability, provided by the photocathode enhancement systems and methods described above, could increase the uninterrupted operating time of these or similar projects by several times. In addition, the photocathode enhancement system of the present application may be useful in a wide range of applications industrial accelerators, such as high beam quality non-destructive testing accelerators.

The components, steps, features, objects, benefits and advantages that have been disclosed above are merely illustrative. None of them, nor the discussions relating to them, are intended to limit the scope of protection in any way. Numerous other embodiments are also contemplated, including embodiments that have fewer, additional, and/or different components, steps, features, objects, benefits and advantages.

Nothing that has been stated or illustrated is intended to cause a dedication of any component, step, feature, object, benefit, advantage, or equivalent to the public. While particular embodiments of the present application have been described, variations of the present application can be devised without departing from the inventive concepts disclosed in the disclosure.

In the present application, reference to an element in the singular is not intended to mean "one and only one" unless specifically so stated, but rather "one or more." All structural and functional equivalents to the elements of the various embodiments described throughout this disclosure, known or later come to be known to those of ordinary skill in the art, are expressly incorporated herein by reference.

What is claimed is:

1. A photocathode enhancement system comprising:

a photocathode having a cathode plate configured to undergo movement relative to an incident optical beam, wherein the cathode plate has an emission surface of an area between about 0.5 $cm^2$ to about 100 $cm^2$; and a motion controller configured to control the movement of the cathode plate relative to the optical beam, so that the optical beam successively strikes non-overlapping portions of the emission surface.

2. The photocathode enhancement system of claim 1, wherein the area of the emission surface of the cathode plate is greater than 100 cm2.

3. The photocathode enhancement system of claim 1, wherein the motion controller is further configured to control movement of the cathode plate so that the optical beam reaches substantially the entire emission surface over a time period.

4. The photocathode enhancement system of claim 3, wherein the time period is between about 10 to about 100 seconds.

5. A system comprising:

a photocathode having a cathode plate movably positioned relative to an incident optical beam, wherein the cathode plate has an emission surface of an area between about 0.5 cm2 to about 100 cm2; and a motion controller configured to control movement of the cathode plate relative to the optical beam, so that the optical beam successively strikes non-overlapping portions of the emission surface;

wherein the optical beam comprises a laser beam.

6. The system of claim 5, wherein charge lifetime QT of the photocathode is between 20,000 C and 100,000 C.

7. The system of claim 1, wherein the motion controller is configured to control the movement of the cathode plate so that on average, heat from the optical beam is uniformly distributed over the emission surface of the cathode plate.

8. The system of claim 1, wherein the movement of the cathode plate has a speed between about 1 cm/sec to about 10 cm/sec.

9. The system of claim 1, wherein the movement of the cathode plate is one of:

a curvilinear motion;

a rectilinear motion; and a combination of curvilinear and rectilinear motions.

10. The system of claim 5, further comprising an UHV (ultra-high-vacuum) bellow and an insulator pillar mounted on a flange of the UHV bellow, wherein the insulator pillar is configured to support the cathode plate.

11. The system of claim 10, wherein the motion controller is further configured to control the motion of the flange of the UHV bellow.

12. The system of claim 5, further comprising a cathode electrode electrically coupled to the cathode plate and separated from the cathode plate by a cathode gap.

13. The system of claim 12, wherein the cathode plate is transversely movable relative to the cathode electrode.

14. The system of claim 12, wherein the anode and the cathode electrode are separated by an accelerating gap, and wherein the accelerating gap has a width of about 2 cm to about 6 cm.

15. The system of claim 5, wherein the laser beam has a spot size of about 2 mm to about 10 mm in diameter, and wherein the sweep time on one or more points on the emission surface of the cathode plate during a sweep cycle is less than about 200 ms.

16. The system of claim 12, wherein the cathode electrode is supported by a HV (high voltage) feedthrough, and further comprising an optics assembly configured to guide the electron beam emitted from the cathode electrode.

17. The system of claim 11, wherein the motion controller comprises a motion confinement system configured to keep the cathode gap and the accelerating gap substantially constant in width, during operation of the system.

18. The system of claim 5, further comprising a laser feedback system configured to correct for uneven QE (quantum efficiency) distribution.

19. The system of claim 1, wherein the cathode plate comprises a plurality of discrete components.

20. A method comprising:

movably positioning a cathode plate of a photocathode relative to an incident laser beam, wherein the cathode plate has an emission surface between about 0.5 $cm^2$ and about 100 $cm^2$; and controlling movement of the cathode plate relative to the optical beam so that the optical beam successively strikes non-overlapping portions of the emission surface.

21. The method of claim 20, wherein the emission surface is great than 100 $cm^2$.

22. The method of claim 20, wherein the act of controlling movement of the cathode plate comprises controlling the movement of the cathode plate so that the laser beam reaches substantially the entire emission surface over a time period, thereby increasing a charge lifetime QT of the photocathode.

23. The method of claim 22, wherein the time period is between about 10 to about 100 seconds.

24. A method comprising:

movably positioning a cathode plate of a photocathode relative to an incident optical beam, wherein the cathode plate has an emission surface between about 0.5 $cm^2$ and about 100 $cm^2$; and controlling movement of the cathode plate relative to the optical beam so that the optical beam successively strikes non-overlapping portions of the emission surface;

wherein the charge lifetime QT of the photocathode is increased to at least 100,000 C, and wherein electron beams emitted by the photocathode in response to the optical beam are unpolarized.

25. The method of claim 20, wherein the act of controlling movement of the cathode plate comprises controlling the movement of the cathode plate so that heat from the laser beam is, on average, uniformly distributed over the emission surface of the cathode plate.

* * * * *